US011485151B2

(12) United States Patent
Shimizu

(10) Patent No.: US 11,485,151 B2
(45) Date of Patent: Nov. 1, 2022

(54) PRINTING APPARATUS, CONTROL METHOD THEREOF, AND STORAGE MEDIUM

(71) Applicant: CANON KABUSHIKI KAISHA, Tokyo (JP)

(72) Inventor: Atsushi Shimizu, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 7 days.

(21) Appl. No.: 17/203,868

(22) Filed: Mar. 17, 2021

(65) Prior Publication Data

US 2021/0331495 A1 Oct. 28, 2021

(30) Foreign Application Priority Data

Apr. 27, 2020 (JP) ..... JP2020-078333

(51) Int. Cl.

*B41J 11/66* (2006.01)
*B41J 2/165* (2006.01)
*B41J 29/17* (2006.01)

(52) U.S. Cl.

CPC ..... *B41J 11/663* (2013.01); *B41J 2/16517* (2013.01); *B41J 29/17* (2013.01); *B41J 2002/16573* (2013.01)

(58) Field of Classification Search

CPC .... B41J 11/663; B41J 2/0451; B41J 2/16505; B41J 2/16517; B41J 2/16579; B41J 2002/16573

See application file for complete search history.

(56) References Cited

U.S. PATENT DOCUMENTS

2019/0210371 A1* 7/2019 Le ..... B41J 2/16526
2020/0156367 A1* 5/2020 Nishio ..... B41J 11/007

FOREIGN PATENT DOCUMENTS

JP 2010-030184 A 2/2010

* cited by examiner

*Primary Examiner* — Scott A Richmond
(74) *Attorney, Agent, or Firm* — Venable LLP

(57) ABSTRACT

In a case where a second page is printed subsequent to a first page, in a case where a predetermined condition concerning recovery operation is met, a control unit in a printing apparatus causes, after completion of printing of the first page and prior to start of the printing of the second page, a recovery unit to perform the recovery operation after causing a cutting unit to cut a printing medium. In a case where the predetermined condition is not met, the control unit causes a printing unit to start the printing of the second page without causing the cutting unit to cut the printing medium after the completion of the printing of the first page.

17 Claims, 10 Drawing Sheets

PRINTING APPARATUS, CONTROL METHOD THEREOF, AND STORAGE MEDIUM

BACKGROUND OF THE INVENTION

Field of the Invention

The present invention relates to a printing apparatus, a control method thereof, and a storage medium.

Description of the Related Art

There is a printing apparatus which performs printing on a print sheet of a rolled shape. There is also a printing apparatus which cuts a first page of a print sheet after performing printing of a second page to a predetermined position without cutting the print sheet immediately after completion of the printing of the first page in performing the printing of a plurality of pages in order to enhance throughput of printing overall.

Japanese Patent Laid-Open No. 2010-30184 (hereinafter referred to as PTL1) discloses a printing apparatus which performs printing on roll paper. The PTL1 discloses that nozzle checking is performed within the printing apparatus by interrupt processing to do cleaning in a case where the number of times a printing operation exceeds a threshold value in the middle of continuous printing of continuously printing a plurality of pages.

However, in some cases, printing result can be affected by doing the cleaning by the interrupt processing in the middle of continuous printing of the plurality of pages on the roll paper so as to enhance the throughput as in PTL1. This is because mist produced by the cleaning adheres to the print sheet.

SUMMARY OF THE INVENTION

A printing apparatus according to an aspect of the present invention includes a conveying unit configured to convey a printing medium, a printing unit configured to perform printing on the printing medium conveyed by the conveying unit, a cutting unit capable of cutting the printing medium, a recovery unit configured to perform recovery operation of recovering the printing unit, and a control unit configured to control the conveying unit, the printing unit, the cutting unit, and the recovery unit, wherein in a case where a second page is printed subsequent to a first page, in a case where a predetermined condition concerning the recovery operation is met, the control unit causes, after completion of the printing of the first page and prior to start of the printing of the second page, the recovery unit to perform the recovery operation after causing the cutting unit to cut the printing medium and in a case where the predetermined condition is not met, the control unit causes the printing unit to start the printing of the second page without causing the cutting unit to cut the printing medium after the completion of the printing of the first page.

Further features of the present invention will become apparent from the following description of exemplary embodiments with reference to the attached drawings.

BRIEF DESCRIPTION OF THE DRAWINGS

FIG. 4 is a diagram showing the relationship of FIGS. 4A and 4B.

DESCRIPTION OF THE EMBODIMENTS

Figure 1:
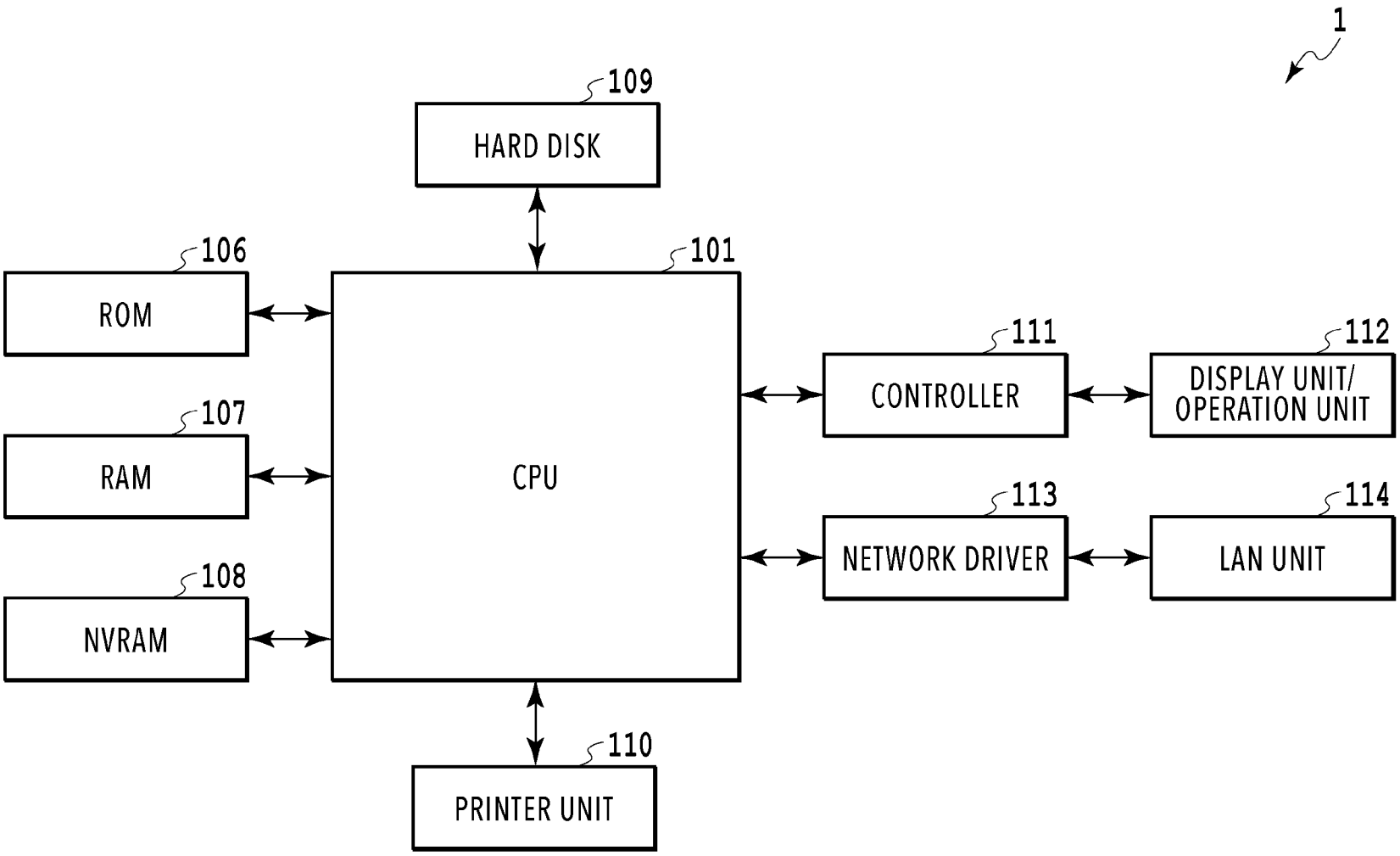
FIG. 1 is a block diagram showing a configuration of a printing apparatus.

Suitable embodiments of the present invention will be described in detail below with reference to attached drawings. It is to be noted that the following embodiments do not limit the present invention as claimed in the claims and not all of the combinations of features described in the present embodiments are essential as solving means of the present invention. The same reference numeral is assigned to the same constituents. Further, a relative arrangement and a shape of constituents or the like described in the embodiments are merely illustrations.

Before specifically describing the present embodiments, a supplementary explanation will be given of a technique of enhancing throughput in continuous printing using a print sheet of a rolled shape. There is a printing apparatus in which the position of a cutter to cut the print sheet of a rolled shape is arranged at a position apart from a carriage including a head used for printing (hereinafter referred to as a print head) and an ink tank. In such a printing apparatus, in performing a print job of a plurality of pages, in a case where control is performed in the order of reception and printing of data corresponding to one page, cutting of paper, conveying operation of the paper, and processing of a next page, it takes time to convey the print sheet to the position of the cutter.

Thus, for the purpose of enhancing the throughput, the printing of the next page is continuously performed without cutting the print sheet after completion of the printing to perform printing corresponding to several bands of the next page which can be printed to the position of the cutter. After that, at a point in time where the print sheet reaches the cutter position, control is performed such that the printing of the next page is temporarily stopped to cut the paper corresponding to the previous page and then the printing of the next page is resumed (hereinafter the present control is referred to as a cut during the printing).

On the other hand, in some cases, cleaning of the print head is performed in the printing apparatus after the completion of the printing corresponding to the one page to maintain printing accuracy (reduce defective printing such as faded printing) in the print job including the plurality of pages. The print job including the plurality of pages include, for example, both of a print job of printing pages each having a different printing image and a print job of printing a plurality of copies of an identical printing image. In the cleaning, preliminary discharge from a nozzle of the print head, ink suction necessary for the printing, and the like are performed.

In the continuous printing including the cut during the printing, in a case of necessity of the cleaning, ink discharge from the nozzle resulting from a factor other than the printing is sometimes performed during printing operation. This ink discharge can cause fine ink to be diffused in the form of mist inside the printing apparatus, whereby there is a case where the mist adheres to the print sheet to affect printing result.

The embodiments to be described below will give, in consideration of the above-described respects, explanations on examples in which the enhancement of the throughput is realized while maintaining the printing accuracy in performing the continuous printing using the print sheet of a rolled shape.

First Embodiment (Configuration of Printing Apparatus)

FIG. 1 is a block diagram showing an internal configuration of a printing apparatus 1 in the present embodiment. The printing apparatus 1 is controlled by a CPU 101 and includes a printer unit 110 which performs printing. A ROM 106 stores a control execution code (program) of the printing apparatus 1. ARAM 107 functions as a memory unit for temporarily storing image data used for the printing or data concerning the control of the printing apparatus 1. A NVRAM 108 is a nonvolatile memory and stores various types of information necessary for maintenance of the printing apparatus 1. A hard disk 109 stores image data used for printing of the printer unit 110.

The printing apparatus 1 includes a display unit/an operation unit 112 having a function as a user interface including an LCD, an LED, a key, or a touch panel for example and execution operation, setting operation or the like of each function of the printing apparatus 1 is performed by a user using the display unit/operation unit 112. A controller 111 transmits, between the display unit/operation unit 112 and the CPU 101, operation instructions thereof and controls the contents of display.

The printing apparatus 1 includes a LAN unit 114 to be connected to an external connection device. The CPU 101 is connected to the LAN unit 114 via a network driver 113. An exchange or the like of an execution command of the printing and a print job (print data) is made by the LAN unit 114 between an external device such as a host apparatus or a server and the printing apparatus 1. For example, in a case where the printing is performed by the printer unit 110, the print job including image data for printing is transferred from the external device via the network driver 113.

Figure 2:
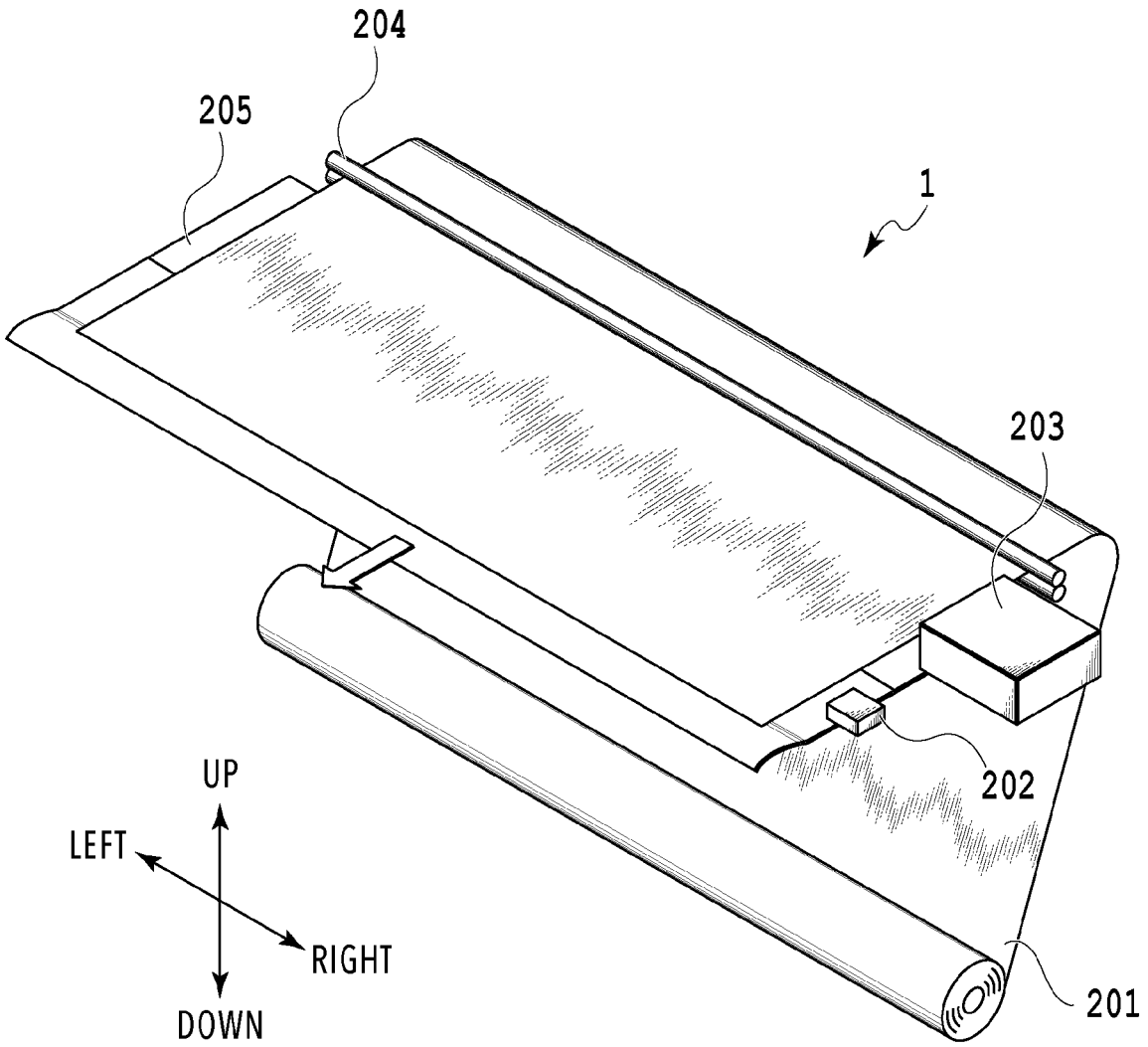
FIG. 2 is a schematic diagram showing a configuration of the printing apparatus.

FIG. 2 is a schematic diagram showing a configuration of the printing apparatus 1 (more specifically, the printer unit 110) in the present embodiment.

A print sheet 201, which is a printing medium, is attached to the printing apparatus 1. The print sheet 201 of the present embodiment is rolled paper. The print sheet 201 is sandwiched between conveying rollers 204 from above and below. The rotation of the conveying rollers 204 performs feeding operation and rewinding operation of the print sheet 201. The printing apparatus 1 includes a motor (not shown) on rotating shafts of the conveying rollers 204 and the rotation of the conveying rollers 204 is performed through drive by the motor. Further, the print sheet 201 is supported from a lower side by a platen 205.

A carriage 203 moves (scans) from right side to left side and from left side to right side in FIG. 2. The print head is mounted on the carriage 203. Printing on the printing medium is performed by discharging ink from the print head. The right side of FIG. 2 is referred to as a reference side and the left side of FIG. 2 is referred to as a non-reference side in the present embodiment. The print head is not shown in FIG. 2 and the explanation thereof will be given with reference to FIGS. 5 and 6, which will be described later.

The printing apparatus 1 includes a cutter unit 202. The print sheet 201 is cut by the cutter unit 202 moving from the reference side to the non-reference side to perform cutting operation. The direction in which the carriage 203 moves is referred to as a main scanning direction. The cutter unit 202 also moves in the main scanning direction. The direction in which the print sheet 201 is fed and rewound by the conveying rollers 204 is referred to as a sub-scanning direction. That is, a sheet conveying direction in which the print sheet 201 is conveyed is also referred to as the sub-scanning direction.

Figure 3:
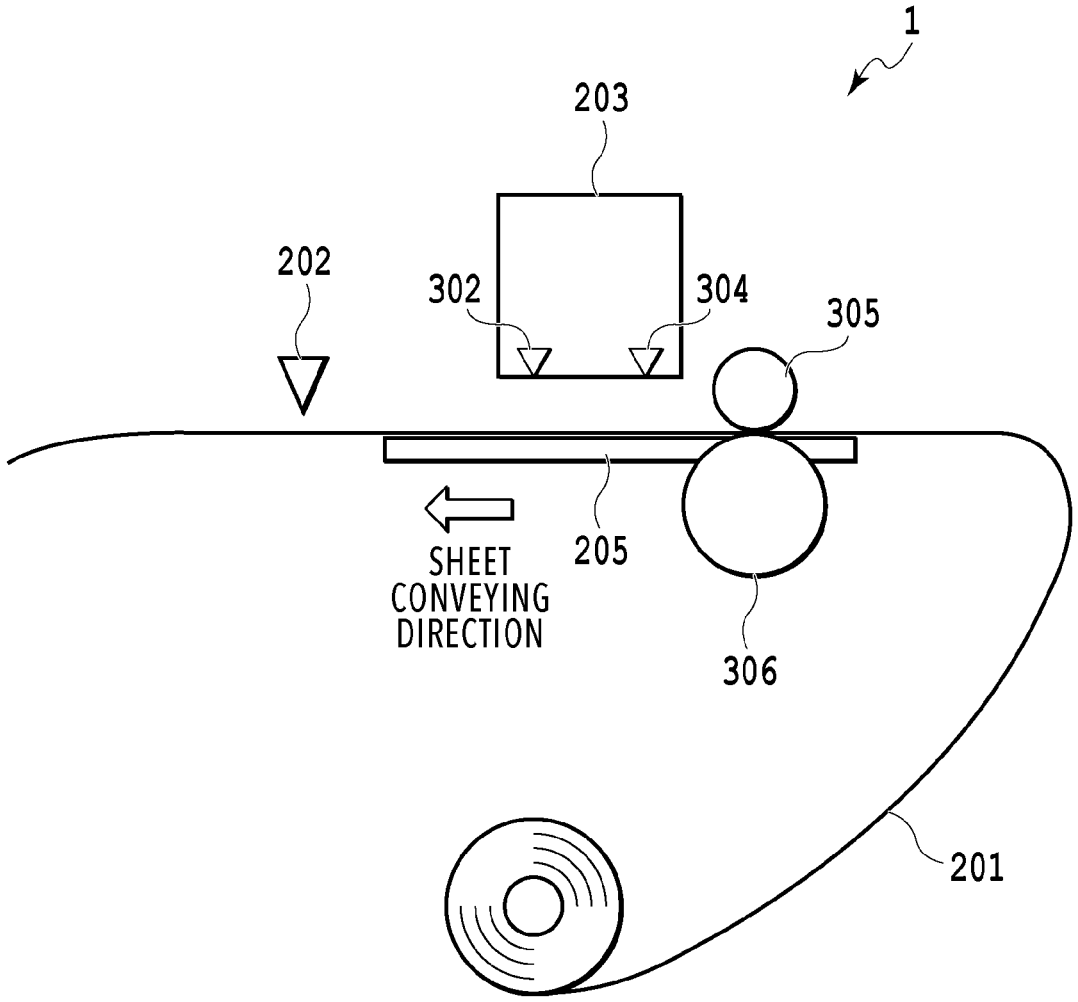
FIG. 3 is a schematic diagram showing a cross section of a paper conveying configuration of the printing apparatus.

FIG. 3 is a schematic diagram showing a cross section of a sheet conveying configuration of the printing apparatus 1 of the present embodiment. Similarly to FIG. 2, the print sheet 201, which is rolled paper, is attached to the printing apparatus 1. More specifically, the conveying rollers 204 are composed of an upper conveying roller 305 and a lower conveying roller 306. The print sheet 201 is sandwiched between the upper conveying roller 305 and the lower conveying roller 306 from above and below. The rotations of the upper conveying roller 305 and the lower conveying roller 306 feed the sheet in the sheet conveying direction shown in FIG. 3. Further, the backward rotations of the upper conveying roller 305 and the lower conveying roller 306 rewind the print sheet 201 in the direction opposite to the sheet conveying direction shown in FIG. 3. The print sheet 201 is supported from the lower side by the platen 205.

In the present embodiment, a side of a sheet conveying path close to the upper conveying roller 305 and the lower conveying roller 306 of FIG. 3 is referred to as an upstream side, and the left side of the sheet conveying path in the sheet conveying direction (the left side of the print sheet 201 in FIG. 3) is referred to as a downstream side. In the printing apparatus 1 of the present embodiment the conveying rollers 204, the carriage 203, and the cutter unit 202 are arranged in this order from the upstream side of the sheet conveying path. Thus, as described above, the print sheet 201 has not reached the position where cutting is performed by the cutter unit 202 at the point in time where the printing of the first page is completed by the print head mounted on the carriage 203. This causes the printing of the second page to be performed subsequent to the printing of the first page to enhance the throughput (the cut during the printing is performed). Additionally, in the case of meeting a predetermined condition, the cut during the printing is not performed and cleaning operation is performed after the cutting of the first page. Description will be given in detail later.

A plurality of nozzles are arranged on the print head mounted on the carriage. Ink is discharged from the nozzles arranged on the print head, thereby performing the printing on the printing medium. A nozzle which is at the position closest to the upstream side is referred to as a most upstream nozzle 304, and a nozzle which is at the position closest to the downstream side is referred to as a most downstream nozzle 302 in the print head.

(Flowchart)

Figure 4A:
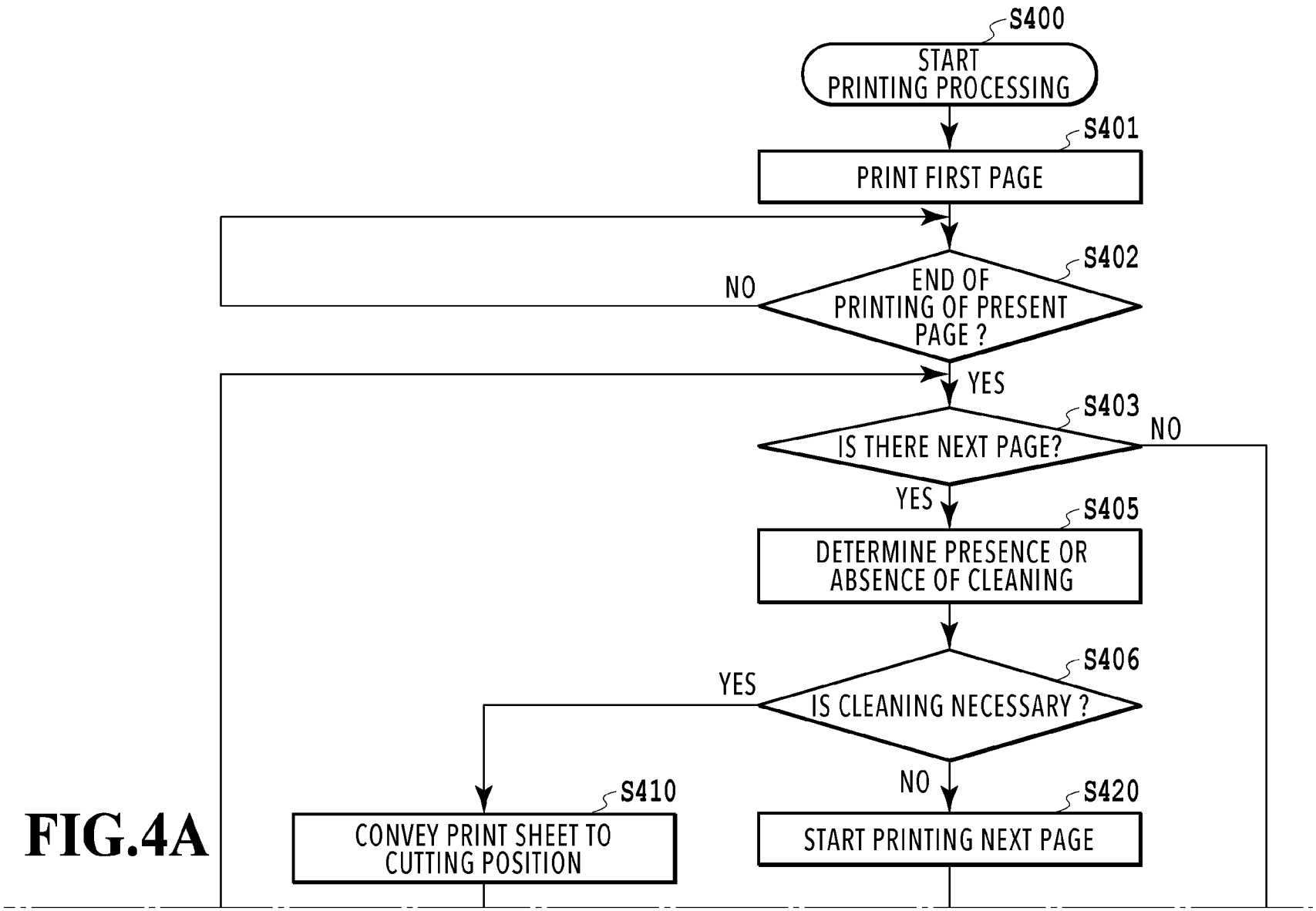
FIGS. 4A and 4B are totally a flowchart showing processing.
Figure 4B:
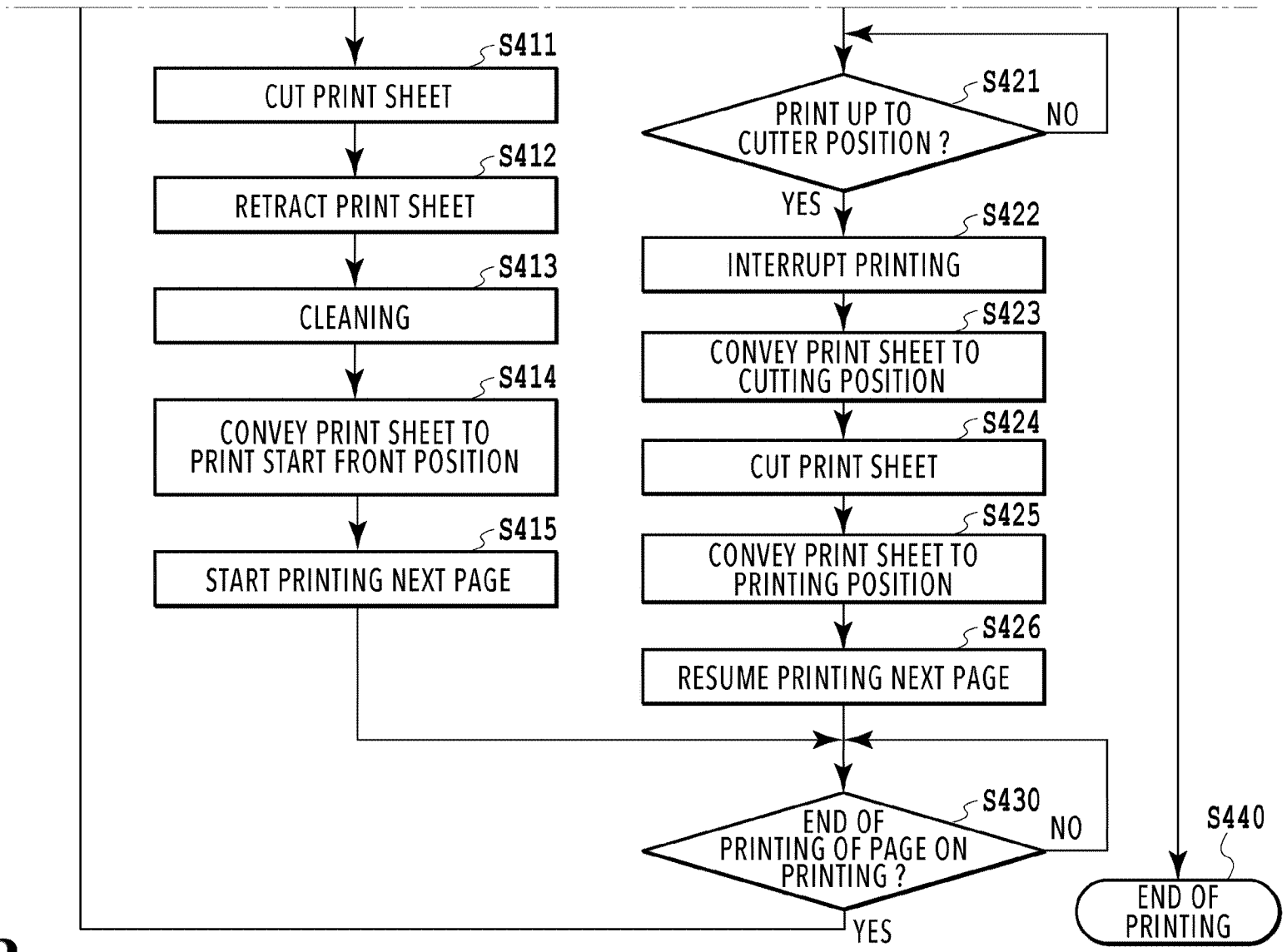

FIGS. 4A and 4B are in combination a flowchart showing processing of the present embodiment. The CPU 101 of the printing apparatus 1 performs the program stored in the ROM 106 or the like, thereby conducting the processing shown in FIGS. 4A and 4B. Incidentally, the sign "S"

described in the explanations on processing indicates a step in the flowchart (the same applies hereinafter in the present specification). Printing processing is started (S400) by transferring data of the print job including printing data to the printing apparatus 1. The print job has a print job header part storing a format for the printing and information on the job and an image data part (print data part) storing actual image data.

In S401, the CPU 101 performs the printing processing of a first page. This means that the CPU 101 conveys the print sheet 201 in the sub-scanning direction by a predetermined amount and discharges the ink while driving the carriage 203 with the ink-filled print head mounted in the main scanning direction. By repeating this operation, an image based on print data of the first page is printed on the print sheet 201.

In S402, the CPU 101 determines whether the printing of the page (that is, the first page) has completed. In a case where the printing of the first page has not completed, the printing continues. In a case where the printing of the first page has completed, the process proceeds to S403.

In S403, the CPU 101 determines whether there is a next page in the print job in execution, which means that the CPU 101 determines whether there is print data of the next page. In the case of no next page, the process proceeds to S440 to end the printing, and end the processing of the present flowchart. In contrast, in a case where there is the next page, the process proceeds to S405.

In S405, the CPU 101 makes a determination of the presence or absence of the cleaning. The cleaning of the present embodiment means recovery operation which recovers the print head mounted on the carriage 203 and the nozzles arranged on the print head. Examples of the cleaning operation include, in order to maintain print quality, ink-filling operation necessary for the printing and operation such as wiping of the nozzles. Such cleaning operation can suppress the defective printing such as the faded printing resulting from insufficient ink in the printing, clogging of the nozzles, or the like. Details on the cleaning operation will be described later with reference to FIGS. 5 and 6.

Basically, the cut during the printing described above is performed to enhance the throughput in the present embodiment. In other words, the printing of the next page is continuously performed without cutting the print sheet to perform the printing corresponding to several bands of the next page which can be printed up to the cutter position. However, there is a case where the cleaning is necessary in printing the next page. In that case, the cut during the printing is not performed but the cleaning operation is performed in the present embodiment. That is, the print sheet 201 is cut without printing the next page and is retracted in order to perform the cleaning operation. In S405, the determination of the presence or absence of the cleaning is made to switch such printing processing of the next page.

As described above, the determination of the presence or absence of the cleaning made in S405 corresponds to a determination whether the cleaning operation (recovery operation) is performed to suppress the defective printing in the print job during the printing processing at the time of printing of the next page onward. Conditions for the determination of the presence or absence of the cleaning are indicated, for example, in Examples 1 to 5 to be described below. In Examples 1 to 5, at the time of the completion of the printing of a current page, the determination is made using at least either of the amount of ink used so far and the amount of ink to be used. In the print head of the present embodiment, in a case where a predetermined amount of ink is used, the cleaning is performed to fill the print head with the ink and to enhance the printing accuracy.

Example 1

Example 1 is an example in which the determination is made based on the amount of ink (hereinafter referred to as a dot count) used by the printing operation and the recovery operation since the previous cleaning execution. The value of the dot count is added to the NVRAM 108 for every ink use and then is stored. The value of the dot count is reset at the time of the execution of the cleaning. It is possible to specify the amount of ink used by the printing operation and the recovery operation since the previous cleaning execution by referencing the value of the dot count. The CPU 101 refers to the value of the dot count stored in the NVRAM 108 to determine the presence or absence of the cleaning. More specifically, the CPU 101 determines that the cleaning is necessary in a case where the value of the dot count exceeds a predetermined value, that is, a case where the amount of ink used exceeds the predetermined value. If not, the determination may be made that the cleaning is unnecessary. It is to be noted that in the case of a plurality of types of ink used in the print head, the determination may be made that the cleaning is necessary in a case where any of the values of the dot counts of the plurality of types of ink exceeds the predetermined value.

Example 2

Example 2 is an example in which the determination is made based on the amount of ink necessary for the printing of the next page in the print job in execution. In other words, it is determined whether the amount of ink stored within a current print head is sufficient for the printing of the next page. For example, the CPU 101 subtracts the value of the current dot count stored in the NVRAM 108 from the dot count at the time of the previous cleaning execution so as to determine a count value (referred to as a first value) corresponding to the amount of ink stored within the current print head. In addition, the CPU 101 analyzes, in S405, the print data used for the printing of the next page to determine the value of dot count (referred to as a second value) necessary for the printing of the next page. The following are methods of determining the value of the dot count necessary for the printing of the next page: the CPU 101 first analyzes the print data of the next page to determine an area to be printed; the CPU 101 then uses the analysis result of the print data to determine the ratio of the area to be printed to a portion to be actually printed (a portion on which the ink is discharged to perform the printing on the print sheet); and this ratio is multiplied by the number of dots of ink necessary for each pixel such that a calculation ratio is obtained. Incidentally, the number of dots of ink for each pixel can be determined, for example, by referring to the density of the printing of the information on the print job. The thus-obtained calculation ratio is referred to as duty. In short, the second value can be obtained with reference to the duty.

Further, in a case where the first value exceeds the second value, it may be determined that it is possible to print the next page with no need for the cleaning. On the other hand, in a case where the first value is less than or equal to the second value, there is a high possibility that ink necessary for the printing of the next page is running out or will run out and it is determined that the cleaning including ink-filling is necessary.

Example 3

Example 3 is an example in which the amount of ink necessary for the printing of the next page onward in the print job in execution is determined based on the information on the print job. In the case of the print job with a plurality of pages, which means a case where the print job includes print data corresponding to the plurality of pages, the analysis of the print data is conducted as well as the printing operation. This can cause a case where the several-page-ahead print data per se has not been received by the printing apparatus 1. Thus, the CPU 101 determines the presence or absence of the cleaning based on the information on the print job.

The information on the print job includes information on the types of images for example. The types of the images include types of sorting colors including monochrome, specified several colors such as two colors, and full color. There also exists a way of sorting depending on the contents to be printed such as a line drawing, an image (a photograph for example), and a mixture thereof.

Another example of the information on the print job is information on image setting. The image setting includes, for example, at the time of printing, thinly printing, thickly printing, and set values for a plurality of phases in the density in the printing. Yet another example of the information on the print job includes set values for a plurality of phases from the viewpoint of a resolution, roughness, fineness, or the like.

Various types of information described above are added to the information on the print job and are, in general, transmitted to the printing apparatus in starting the printing. Therefore, at the time of S405 when the printing of the front page completes, the CPU 101 is capable of obtaining the various types of information. The CPU 101 then refers to these various types of information to estimate the necessary value of the dot count (referred to as a third value). The CPU 101 compares the first value with the third value described above and determines, in a case where the first value exceeds the third value, that it is possible to print the next page onward and may determine that the cleaning is unnecessary. On the other hand, in a case where the first value is less than or equal to the third value, the CPU 101 determines that the cleaning is necessary.

Example 4

Example 4 is an example of a configuration of the printing apparatus 1 in which an operator can set a print setting. The CPU 101 displays setting items on an LCD screen provided as the display unit/operation unit 112 to determine the presence or absence of the cleaning based on the contents set by the operator through an operation panel. For example, the operator can make a setting such that priority is placed on the maintenance of the print quality or can make a setting such that priority is placed on print speed. The setting is not limited to these two options and may be a setting including a plurality of phases. In addition, the contents set in the external device may be received and set by the printing apparatus 1 through the LAN unit 114 or the like. The contents set in such a manner are stored in a predetermined area in the RAM 107 or the NVRAM 108. The setting may be a setting limited to the print job in execution or may be a setting which is applied to all the print jobs executed by the printing apparatus 1. An example of a setting screen will be described later with reference to FIGS. 9A and 9B.

Example 5

Example 5 is an example in which the determination is made according to the actual amount used in the printing apparatus 1. The CPU 101 stores, in the predetermined area in the NVRAM 108, a predetermined number of pieces of information selected out of the information on the print job described in Example 3 and the information on the print setting described in Example 4 to specify a tendency. For example, the tendency can be specified according to items such as the type of the images which is most frequently printed, roughness in an image setting, the resolution of the images, and the contents of the print setting described in Example 4 which are most frequently set. A combination thereof may be used for the determination. Processing equivalent to the processing described in Example 3 or 4 may also be performed according to the specified tendency. Further, a learning function may be retained in the ROM 106 to determine the tendency based on the result learned through the learning function.

The presence or absence of the cleaning may be determined either according to each of Examples 1 to 5 described above or a combination of determining conditions of Examples 1 to 5.

Returning to the description of the flowchart of FIG. 4A, the process proceeds to S406 after the determination of the presence or absence of the cleaning has been made in S405. In S406, the CPU 101 determines whether the cleaning is necessary. In a case where the cleaning is necessary, steps from S410 to S415 are to be performed. In a case where the cleaning is unnecessary, steps from S420 to S426 are to be performed.

The processing in the case of necessity of the cleaning will be described. In S410, the CPU 101 conveys the print sheet to a position where it is cut. In S411, the CPU 101 causes the cutter unit 202 to cut the print sheet. In S412, the CPU 101 retracts the print sheet. In S413, the CPU 101 performs the cleaning. In S414, the print sheet is conveyed to a head position where the printing starts. In S415, the CPU 101 starts the printing of the next page. The detailed descriptions on S410 to S415 will be given with reference to FIG. 7, which will be described later, along with specific examples. After S415, the process proceeds to S430.

Next, the processing in the case where the cleaning is unnecessary will be described. In the case where the cleaning is unnecessary, operation of the above-described cut during the printing is performed, that is, the printing of the next page is performed in succession to the printing of the previous page without conveying the print sheet to the cutting position. In S420, the CPU 101 starts the printing of the next page. In S421, the CPU 101 determines whether the printing is performed up to the cutter position. In a case where the printing is not performed up to the cutter position, the printing continues. In a case where the printing is performed up to the cutter position, the process proceeds to S422 and the CPU 101 interrupts the printing. In S423, the CPU 101 conveys the print sheet to the cutting position. In some cases, the position at which the printing has been interrupted in S422 does not necessarily correspond to the cutting position of the print sheet. For example, depending on the amount of conveyance and the contents of the printing of the print sheet, there is a case where the rear end of the previous page goes beyond an area to be the cutter position in a conveying direction. In this case, conveyance is performed in S423. In S424, the CPU 101 cuts the print sheet. In S425, the CPU 101 conveys the print sheet to a printing position. Incidentally, in a case where the conveyance is unnecessary in S423, the processing of S425 may be skipped. In S426, the CPU 101 resumes the printing of the next page. The detailed descriptions on S420 to S426 will be given with reference to FIG. 8, which will be described later, along with specific examples. After S426, the process proceeds to S430.

In S430, the CPU 101 determines whether the printing of the page on-printing has completed. In a case where the printing has not completed, the printing continues to repeat the determination until the end of the printing. In a case where the printing has completed, the process returns to S403 to repeat the above-described processing. In the case of no next page to be printed, the process proceeds to S440 where the process completes. The above is an explanation of a series of the steps. After the end of the printing in S440, the printing apparatus 1 makes a transition to a print standby state. In a case where the printing apparatus 1 obtains the print job to be processed next, the processing shown in FIGS. 4A and 4B is again performed.

(Descriptions on the Cleaning)

Figure 5:
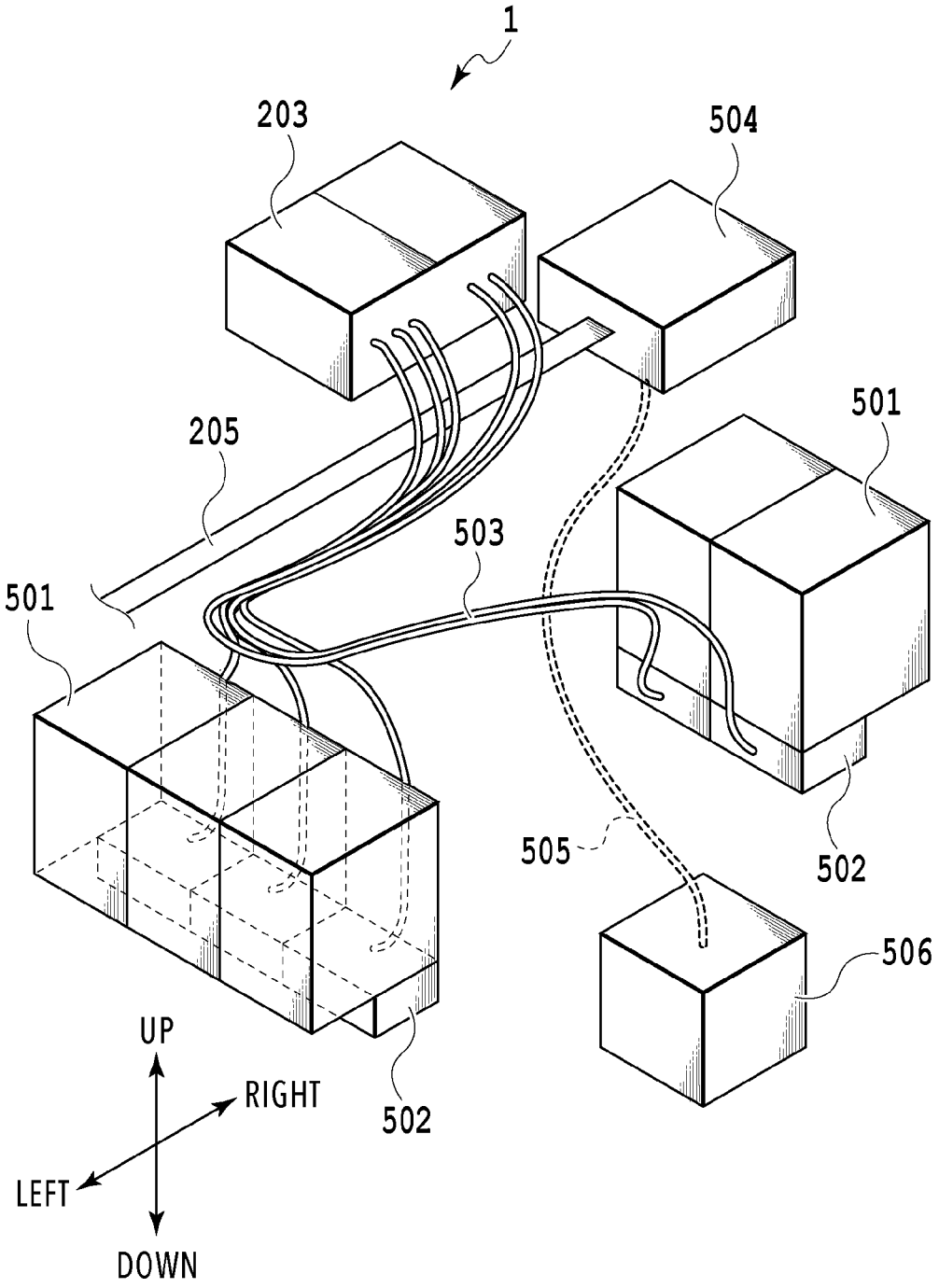
FIG. 5 is a schematic diagram showing a configuration for recovery operation of the printing apparatus.
Figure 6:
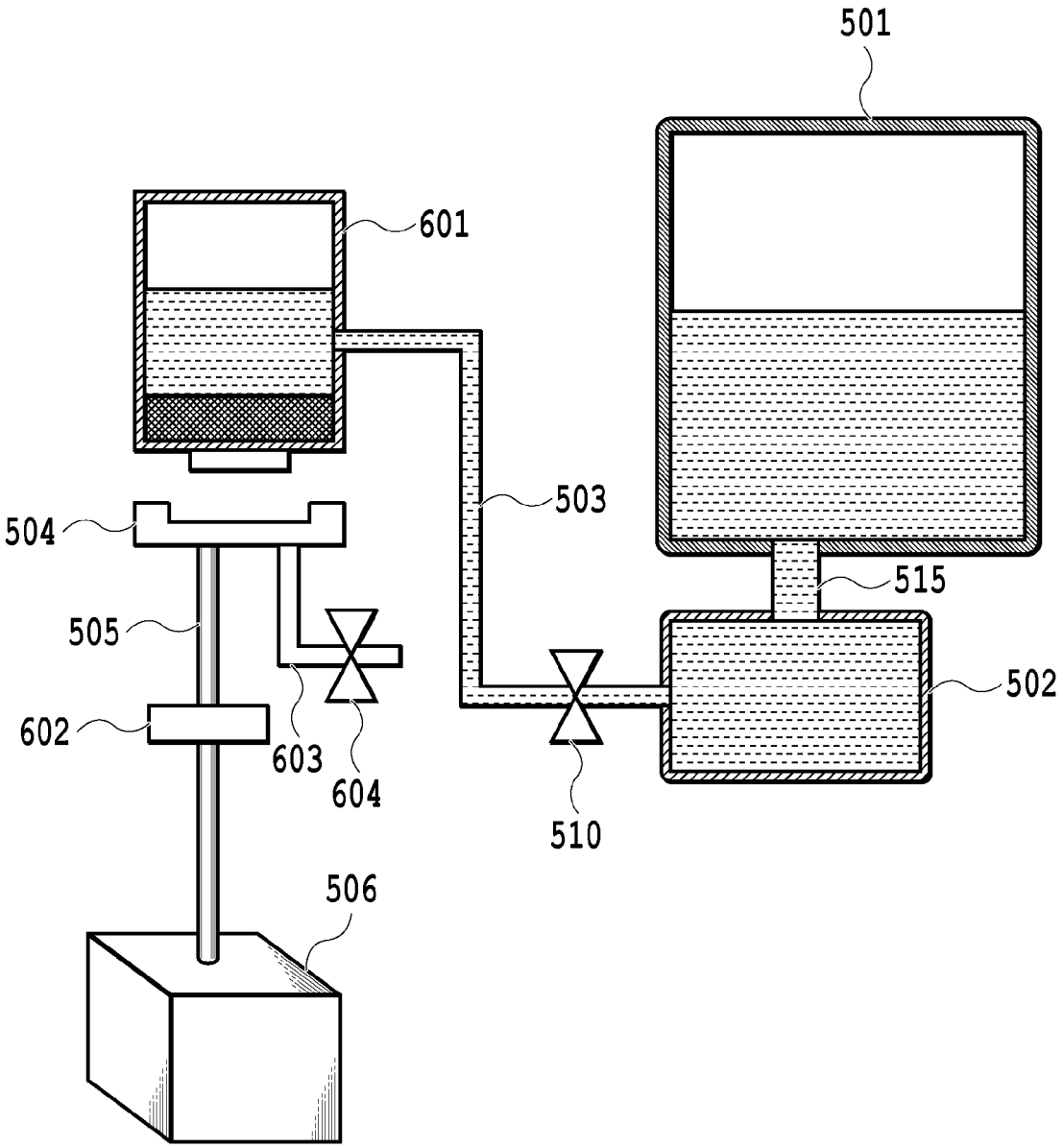
FIG. 6 is a schematic diagram showing an ink supply system between a print head and an ink tank.

FIG. 5 is a schematic diagram showing a configuration related to the recovery operation of the printing apparatus 1 (more specifically, the printer unit 110) of the present embodiment. FIG. 6 is a schematic diagram showing an ink supply system mainly between a print head 601 and an ink tank 501. The descriptions on the cleaning will be given below with reference to FIGS. 5 and 6.

As shown in FIG. 5, the ink tanks 501 are prepared depending on the number of the ink colors of inks mounted in the printing apparatus 1. In an example shown in FIG. 5, it is indicated that the printing apparatus 1 uses five types of ink colors including cyan, magenta, yellow, black, and matte black. The ink tanks 501 respectively corresponding to these five types of ink colors are attached to the printing apparatus 1. FIG. 5 shows an example in which a total of five ink tanks 501 are attached to the printing apparatus 1.

It is to be noted that the five ink tanks 501 are arranged on both sides of the printing apparatus 1 in FIG. 5. In other words, the three ink tanks 501 are arranged at the left side of FIG. 5 and the two ink tanks 501 are arranged at the right side of FIG. 5. The ink tanks 501 are not limited to the example shown in FIG. 5 in which the tanks are arranged at both sides and may be arranged at one side.

A sub tank 502 is attached to each of the ink tanks 501. The ink tank 501 is connected to the sub tank 502 via an ink supply port 515 as shown in FIG. 6. Ink within the ink tank 501 is supplied to the sub tank 502 through the ink supply port 515. The sub tank 502 is connected to a supply tube 503, which is connected to the print head 601. In this manner, the printing apparatus is configured such that ink is supplied to the print head 601 favorably through the supply tube 503 while maintaining a balance between pressure within the ink tank 501 and atmospheric pressure. Incidentally, the number of the supply tube 503 to be used is also equal to the number of the types of ink mounted in the printing apparatus 1.

The print head 601 is mounted on the carriage 203 as described above and moves above the platen 205 in the main scanning direction corresponding to the horizontal direction in FIG. 5. During this movement, ink is discharged from the print head 601 into the printing medium (the print sheet 201 shown in FIG. 3, for example) on the platen 205 via the nozzles included in the print head, thereby performing the printing on the print sheet 201.

In non-print operation, the print head 601 suppresses moisture from ink from evaporating by covering all the nozzles by a cap 504 (hereinafter referred to as capping). The cap 504 is connected to a pump tube 505. A suction pump 602, by its drive, makes it possible to suction the interior of the cap 504 via the pump tube 505. Ink flowed into within the pump tube 505 driven by the suction pump 602 is stored in a waste ink absorbing member 506. It is to be noted that in a case where the waste ink absorbing member 506 is full of ink, it is configured to forcefully stop the driving by the suction pump 602 so as not to store any more ink. The waste ink absorbing member 506 is configured to be detachable and exchangeable.

The interior of the cap 504 will be described with reference to FIG. 6. The interior of the cap 504 is connected to a tube 603 on which a valve 604 is provided. Switching this valve 604 makes it possible to cause the interior of the cap 504 to be in communication with the atmosphere as necessary in the case of the print head 601 being capped. The supply tube 503 causing the sub tank 502 and the print head 601 to be in communication with each other is also provided with a valve 510 which switches ink supply.

The print head 601 includes a storage chamber to store ink supplied from the sub tank 502 and a nozzle to discharge the ink. In a case where the remaining amount of ink stored within the print head 601 becomes scarce, the print head is filled with ink from the sub tank 502 through the cleaning process.

Regarding the configurations shown in FIGS. 5 and 6, descriptions will be given of a way of carrying out the cleaning operation (recovery operation). The cleaning operation of the present embodiment can include preliminary discharging operation, wiping operation, and suction recovery operation. In the preliminary discharging operation, preliminary discharge to discharge ink from the print head 601 into the cap 504 is performed at a predetermined timing. In the wiping operation, wiping to wipe the nozzles (the discharge port surface for ink) by means of a blade (not shown) is performed. In the suction recovery operation, suction recovery is performed whose details are as follows: the suction pump 602 is driven in a state in which all of the nozzles of the print head 601 are covered by the cap 504, and pressure within the cap is caused to be negative to suction ink from the print head 601 to be discharged. In the suction recovery, in addition to the above-described operation, the interior of the print head 601 is supplied with ink within the sub tank 502 by opening the valve 510.

In the cleaning operation, any of the preliminary discharging operation, the wiping operation, and the suction recovery operation is performed singly or a combination thereof is performed at a predetermined timing. For example, the preliminary discharging operation and the wiping operation are performed in a case where the amount of ink used in printing on the print sheet exceeds a predetermined amount or time in which the printing is continuously executed elapses a predetermined time. The expected predetermined time is about seven minutes for example. However, time may be changed according to the contents of the printing and the contents of the print jobs in execution. Further, the preliminary discharging operation and the wiping operation are also operations which suppress the influence of the density of ink caused by evaporation of moisture from ink resulting from a lapse of time. Thus, the predetermined time may be changed depending on conditions such as the types of ink, surrounding temperatures, and humidity.

The suction recovery operation is performed in a case where the predetermined (relatively large) amount of ink is used by printing on the print sheet after the previous suction recovery. The preliminary discharging operation and the wiping operation are also performed successively after the suction recovery operation has been performed. The suction recovery operation is a relatively heavy recovery operation in which air bubbles present in the ink in the supply tube 503 and inside the print head 601 can be removed and this operation requires a lot of time and ink.

Specific Examples

Figure 7:
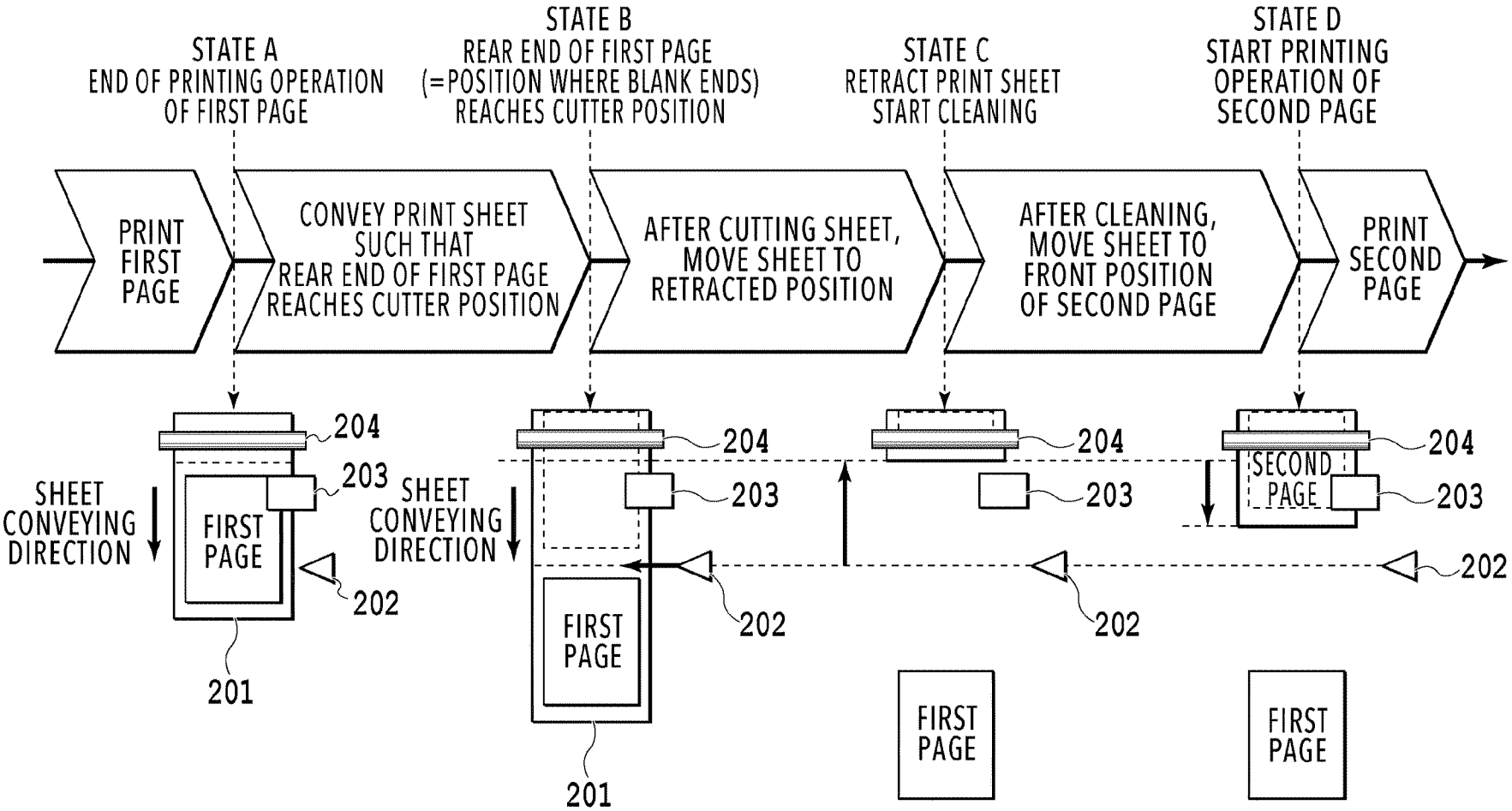
FIG. 7 is a diagram showing order of cutting to be performed after printing in the printing apparatus.

FIG. 7 is a diagram showing execution order of cutting to be performed after the printing of the first page in the printing apparatus 1 of the present embodiment. Specific examples will be described with reference to FIG. 7. FIG. 7 indicates a process in which a print start of the second page (the second page) is reached after the printing of the first page (the first page) in the printing apparatus 1 in the case of printing the plurality of pages. FIG. 7 also indicates the states of the print sheet 201, the cutter unit 202, and the carriage 203 and a positional relationship therebetween. In the process of FIG. 7, it is assumed that the above-described cleaning is performed before the print start of the second page after the printing of the first page. In other words, the process starting from S410 through S415 of FIGS. 4A and 4B is described. FIG. 7 uses the printing of the first page and the second page as examples. In a case where a print page from a third page onward exists, the first page and the second page of FIG. 7 may be read as the present page and the next page, respectively.

The positional relationship after the printing of the first page is indicated as a state A. The downward direction of FIG. 7 is set to be the sheet conveying direction. The state A is a state in which the print sheet 201 is conveyed such that the carriage 203 is positioned at the print rear end position of the first page. The print sheet 201 is conveyed by the conveying rollers 204 as described above.

The print sheet 201 is then conveyed to an area to be the cutter position where the rear end of the first page is cut by the cutter unit 202. This means that the print sheet 201 is conveyed in the sheet conveying direction by a distance produced by taking the sum of a distance corresponding to a distance from the print rear end position of the first page to a rear end blank and a distance between the carriage 203 and the cutter unit 202. This operation corresponds to the conveying operation in S410 of FIG. 4A.

The positional relationship in which the rear end of the first page of the print sheet 201 is conveyed to the cutter position of being cut by the cutter unit is indicated as a state B. In the state B, the first page of the print sheet 201 is cut by operating the cutter unit 202. This operation corresponds to the cutting operation in S411 of FIG. 4B. Incidentally, in a case where the cutter unit 202 is configured to be driven in one direction to cut the print sheet 201, the cutter unit 202 returns to an original position (that is, moves to the reference side) after cutting the print sheet 201. For example, a motor driving the cutter unit 202 may be driven in a reverse direction. In a case where the cutter unit 202 is configured to be driven in both directions to be capable of cutting the print sheet 201, the cutter unit 202 stays at the non-reference side after cutting the print sheet 201. The cutter unit 202 may then be driven to the reference side in cutting the print sheet 201 next time to return to an original conveying-reference position while cutting the print sheet 201.

Next, the print sheet 201 is conveyed, in order to do the cleaning, to an upstream side relative to the carriage 203 (the side where the upper conveying roller of the conveying rollers 204 is arranged in FIG. 7) to retract the print sheet 201 from the position of the carriage 203. The positional relationship in which the print sheet 201 is retracted into a retracted position is indicated as a state C. This operation corresponds to retracting operation in S412 of FIG. 4B. The cleaning causes fine misty ink to flow down to the bottom of the carriage 203 and sometimes the misty ink adheres to the print sheet 201, which results in influence on the printing result in some cases. Thus, the print sheet 201 is conveyed to be retracted from the position of the carriage 203.

The cleaning operation is then performed on the print head 601 mounted on the carriage 203 by the method described with reference to FIGS. 5 and 6. This operation corresponds to the cleaning operation in S413 of FIG. 4B.

After the completion of the cleaning, the print sheet 201 is conveyed to the print start position of the second page to print the second page, which is the next page. The print start position of the second page is a position where the printing starts by the carriage 203 (the print head 601). This operation corresponds to the conveying operation in S414 of FIG. 4B. The positional relationship in which the print sheet 201 is conveyed to the print start position of the second page is indicated as a state D.

Next, the printing operation of the second page is performed. This operation corresponds to print start operation in S415 of FIG. 4B. The above-described examples are specific examples, corresponding to S410 to S415 of FIGS. 4A and 4B, in the case of performing the cleaning operation before the start of printing of the next page after the completion of printing of the present page.

Figure 8:
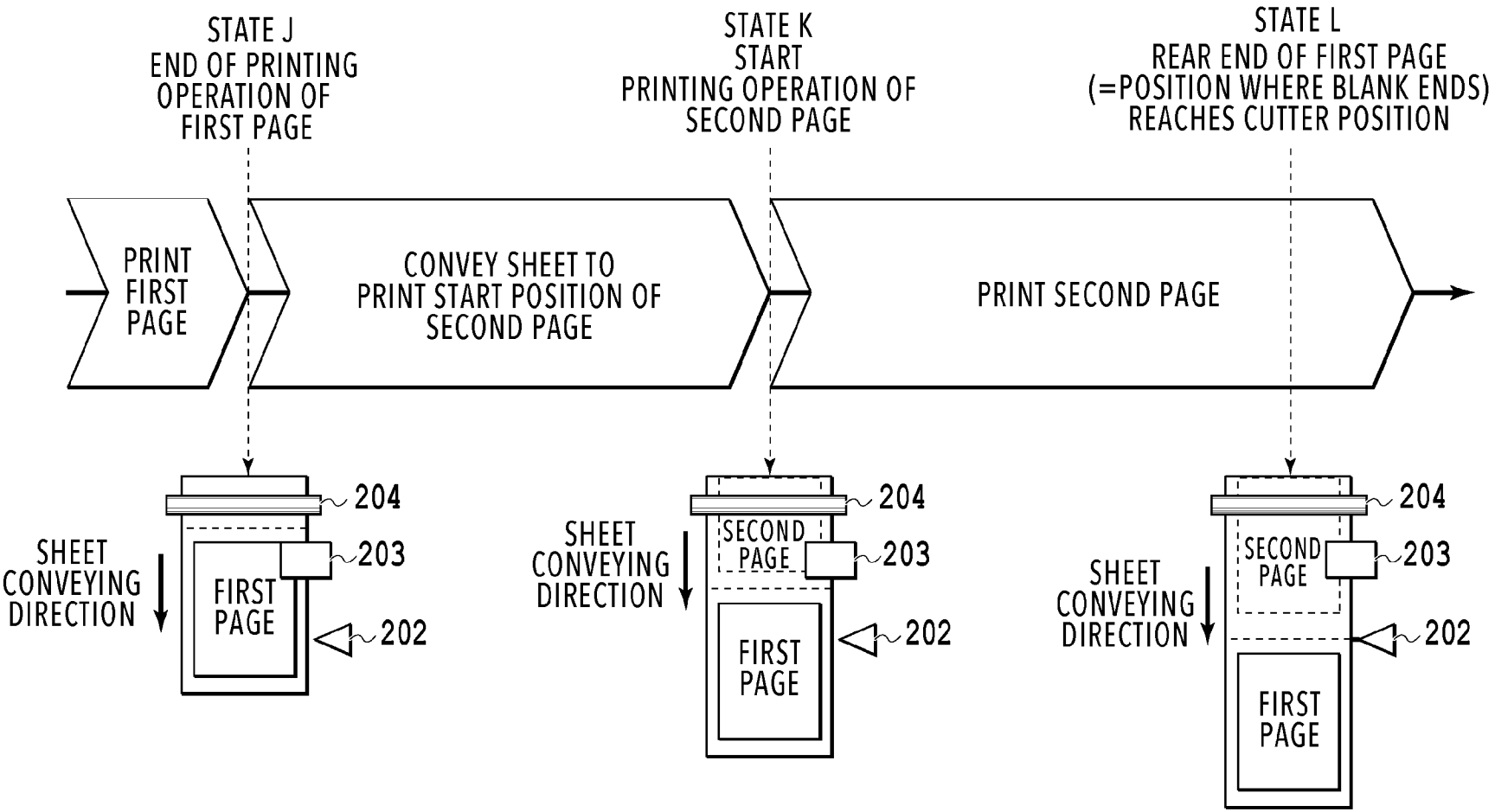
FIG. 8 is a diagram showing order of cutting to be performed during printing in the printing apparatus.

FIG. 8 is a diagram showing order of executing the cut during the printing in the printing apparatus of the present embodiment. FIG. 8 indicates a process in which a print start of the second page is reached after the printing of the first page in the printing apparatus 1 in the case of printing the plurality of pages. FIG. 8 also indicates the states of the print sheet 201, the cutter unit 202, and the carriage 203 and a positional relationship therebetween. In the process of FIG. 8, it is assumed that the printing of the second page is continuously performed after the completion of the printing of the first page and the print sheet 201 is cut by using the cutter unit 202 during the printing of the second page. In other words, the cleaning operation as described in the example of FIG. 7 is not performed. That is, FIG. 8 indicates a process starting from S420 through S426 of FIGS. 4A and 4B. FIG. 8 also uses the printing of the first page and the second page as examples. In a case where a print page from a third page onward exists, the first page and the second page of FIG. 8 may be read as the present page and the next page, respectively.

The positional relationship at the time of the completion of the printing of the first page is indicated as a state J. The downward direction of FIG. 8 is set to be the sheet conveying direction. The state J is a state in which the print sheet 201 is conveyed such that the carriage 203 is positioned at the print rear end position of the first page.

Next, the printing apparatus is controlled to print the second page without cutting the first page of the print sheet 201 in order to enhance the throughput. This means that the print sheet 201 is conveyed such that the carriage 203 is positioned at the print start position of the second page. The positional relationship in which the print sheet 201 is conveyed to the print start position of the second page is indicated as a state K. The printing of the second page then starts. These actions correspond to the print start operation in S420 of FIG. 4A.

The print sheet 201 is conveyed while the printing is performed until the rear end of the first page comes to the area to be the cutter position. This operation corresponds to the case of Yes (the printing has been performed up to the cutter position) in the determination whether the printing has been performed up to the cutter position in S421 of FIG. 4B. In the case of No (the printing has not been performed up to the cutter position) in the determination in S421, the printing continues until the determination is again made to find that the printing has been performed up to the cutter position.

The positional relationship at the time of the rear end of the first page reaching the area to be the cutter position is indicated as a state L. The printing of the second page is once interrupted in this state. This operation corresponds to print interrupt operation in S422 of FIG. 4B. This means stopping conveyance of the print sheet 201 and operation of the carriage 203. Incidentally, depending on the amount of conveyance and the contents of the printing of the print sheet 201, there arises a case where the rear end of the first page goes beyond the area to be the cutter position in the conveying direction, that is, a case where the rear end of the first page reaches a position in a downward direction (the downstream side) of FIG. 8 relative to the position of the cutter unit 202. In that case, operation of conveying the print sheet 201 to the rear end of the first page is performed. This operation corresponds to the conveying operation in S423 of FIG. 4B. After that, the first page is cut by operating the cutter unit 202. This operation corresponds to the cutting operation in S424 of FIG. 4B.

Afterward, the interrupted printing of the second page resumes. In a case where the rear end of the first page goes beyond the area to be the cutter position in the conveying direction, in the case of performing processing in which the print sheet 201 is conveyed to the rear end of the first page, it is necessary to convey the print sheet 201. This means that it is necessary to return the print sheet 201 to the interrupted position before resuming the printing of the second page. In this case, operation in which the print sheet is conveyed by a distance by which the print sheet 201 has been conveyed from the interrupted position is performed such that the print sheet returns to the original position. This operation corresponds to the conveying operation in S425 of FIG. 4B. Incidentally, even though S425 indicates that the print sheet is conveyed to the printing position, this is equivalent to conveying the print sheet 201 such that the print sheet returns by the distance in which the print sheet has been conveyed. After that, the printing of the second page resumes. This operation corresponds to print resuming operation in S426 of FIG. 4B. The above descriptions are made of the specific examples.

Figure 9A:
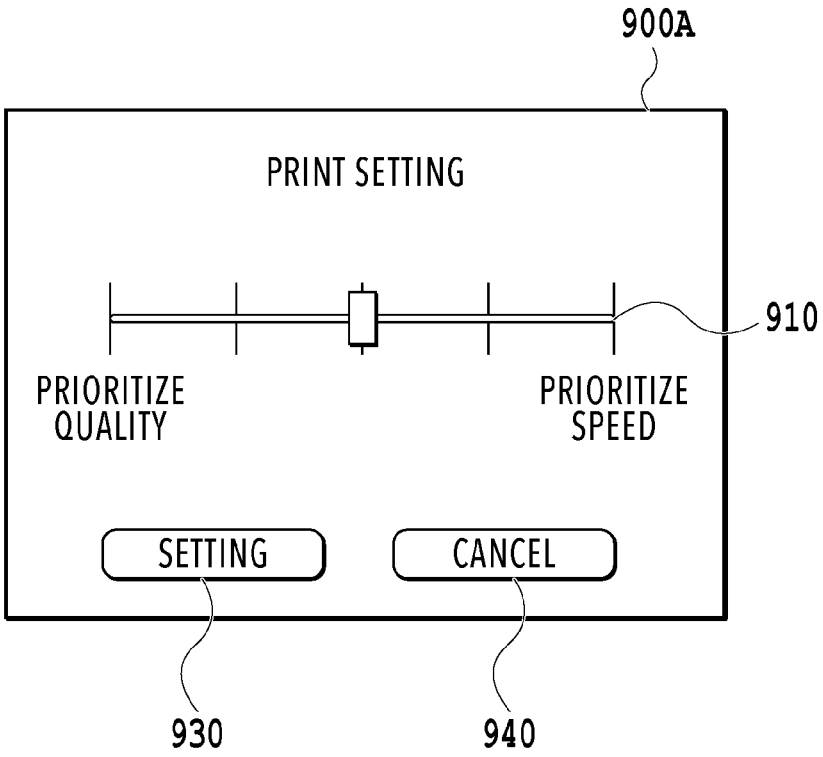
FIGS. 9A and 9B show examples of an input screen where a print setting is selected.
Figure 9B:
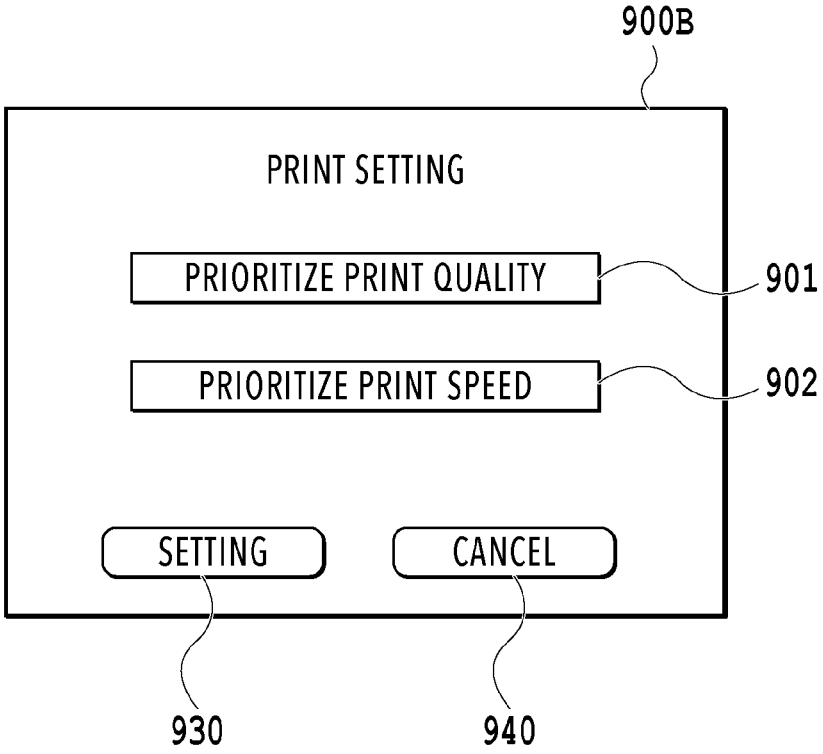

FIGS. 9A and 9B show examples of an input screen where prioritizing print quality or prioritizing print speed is selected in the print setting of the present embodiment. This print setting is used in the case of Example 4 in the determination of the presence or absence of the cleaning in S405 of FIG. 4A. The screens shown in FIGS. 9A and 9B are displayed on an LCD display provided as the display unit/operation unit 112. FIG. 9A shows an example of a screen in which it is possible to set the print setting in the plurality of phases and FIG. 9B shows an example of a screen in which the print setting is set from two alternative settings.

On a screen 900A of FIG. 9A, it is possible to input the gradual setting, by a slide bar 910, as to whether the priority is placed on the print quality or print speed regarding the printing in the printing apparatus 1. The current set value is stored in the predetermined area in the RAM 107 or NVRAM 108. With reference to the value, the CPU 101 may display the current set value as a default in starting the display of the screen 900A. In the present example, it is assumed that the slide bar 910 is operated through the touch panel of the LCD display provided as the display unit/operation unit 112. Alternatively, a key is provided as the display unit/operation unit 112 and input may also be done by pressing the key.

On the screen 900A, the closer to "PRIORITIZE QUALITY" (the left side of FIG. 9A) the input position of the slide bar 910 is, the higher priority is placed on the maintenance of the print quality in the setting. In the case of prioritizing the quality in the setting, the determination is to be made in such a manner that the frequency of the cleaning to be performed is set to be relatively high in the determination of the presence or absence of the cleaning. For example, in a case where the slide bar 910 is positioned closest to "PRIORITIZE QUALITY" on the screen 900A, the cleaning is set to be performed every five pages in printing the image of an A1-size draft. On the other hand, the closer to "PRIORITIZE SPEED" (the right side of FIG. 9A) the input position of the slide bar 910 is, the less the frequency of the cleaning to be performed is such that print execution is prioritized. For example, in a case where the slide bar 910 is positioned closest to "PRIORITIZE SPEED" on the screen 900A, the cleaning is set to be performed every twenty pages in printing the image of the A1-size draft. More specifically, these intervals are determined according to the contents of the print job, the print data, the print speed, the dot count, and the like. In a case where the slide bar 910 is at a midpoint position between "PRIORITIZE QUALITY" and "PRIORITIZE SPEED," the determination of the presence or absence of the cleaning is made so as to strike a balance between the quality and speed.

Incidentally, the input of whether to prioritize the print quality or print speed may be done from the two alternatives. For example, as shown in a screen 900B of FIG. 9B, a button 901 to prioritize the print quality and a button 902 to prioritize the printing are displayed and may be selected by the operator. In both cases of screen 900A and screen 900B, a setting button 930 and a cancel button 940 are displayed and in a case where the setting button 930 is pressed down, the setting of the contents selected by using the slide bar 910, button 901, or button 902 is reflected. That is, the set value for the selected contents is stored in the predetermined area in the RAM 107 or NVRAM 108. In the case of pressing down the cancel button 940, the setting on the screen is not reflected. In the case of pressing down the setting button 930 and cancel button 940, the setting ends in either case to return to the original screen.

As described above, in the present embodiment, the determination of the presence or absence of execution of the cleaning is made after the completion of printing data corresponding to one page. In addition, in the case of determining that the cleaning is necessary, the printed print sheet is cut and retracted for the cleaning. In contrast, in the case of determining that the cleaning is unnecessary, the printing of the next page is performed without cutting the print sheet until the print sheet reaches the cutter position and the printing is then temporarily stopped to cut the sheet. By performing the above-described control, it is possible to enhance the throughput during printing while maintaining the printing accuracy (reducing the defective printing such as the faded printing).

It is to be noted that in a case where the cut during the printing described above is not performed in the printing apparatus 1, it is not necessary to perform the operation in the flowchart of FIGS. 4A and 4B. With respect to carrying out or not carrying out the cut during the printing, the set values, for example, may be maintained as the print setting in the printing apparatus 1. In the case of printing a page requiring a large dot count including a case of printing data having relatively high duty (for example an image printed all across an A1-size sheet), the cleaning operation is performed relatively frequently. In this case, the effect of enhancing the throughput which can be obtained by the cut during the printing is reduced. In such a case, it is not necessary to carry out the cut during the printing.

Other Embodiments

The printing apparatus in which the carriage with the print head mounted moves in the main scanning direction and discharges ink from the print head, thereby printing the print sheet has been used as an example in the above-described embodiments. However, the present invention is not limited to this example. For example, the above-described control may be performed in a printing apparatus using a print head on which nozzles corresponding to a length in a width direction of a print sheet are arranged.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-078333, filed Apr. 27, 2020, which is hereby incorporated by reference herein in its entirety.

What is claimed is:

1. A printing apparatus comprising:

a conveying unit configured to convey a printing medium;

a printing unit configured to perform printing on the printing medium conveyed by the conveying unit;

a cutting unit capable of cutting the printing medium;

a recovery unit configured to perform recovery operation of recovering the printing unit; and a control unit configured to control the conveying unit, the printing unit, the cutting unit, and the recovery unit, wherein in a case where a second page is printed subsequent to a first page, in a case where a predetermined condition concerning the recovery operation is met, the control unit causes, after completion of the printing of the first page and prior to start of the printing of the second page, the recovery unit to perform the recovery operation after causing the cutting unit to cut the printing medium, and in a case where the predetermined condition is not met, the control unit causes the printing unit to start the printing of the second page without causing the cutting unit to cut the printing medium after the completion of the printing of the first page.

2. The printing apparatus according to claim 1, wherein the predetermined condition is a condition in which it is determined that the recovery operation is necessary prior to printing the second page.

3. The printing apparatus according to claim 1, wherein the predetermined condition is based on an amount of ink used since execution of previous recovery operation at the time of the completion of the printing of the first page.

4. The printing apparatus according to claim 1, wherein the predetermined condition is based on an amount of ink necessary for the printing of the second page at the time of the completion of the printing of the first page.

5. The printing apparatus according to claim 1, wherein the predetermined condition is based on information on a print job for the second page onward at the time of the completion of the printing of the first page.

6. The printing apparatus according to claim 5, wherein the information on the print job for the second page onward includes information on a type of an image to be printed.

7. The printing apparatus according to claim 5, wherein the information on the print job for the second page onward includes information on a setting of the image to be printed.

8. The printing apparatus according to claim 5, wherein the information on the print job for the second page onward includes information on a resolution of the image to be printed.

9. The printing apparatus according to claim 1, wherein the predetermined condition is based on a print setting set by the printing apparatus.

10. The printing apparatus according to claim 1, wherein the predetermined condition is based on an actual amount used in the printing apparatus.

11. The printing apparatus according to claim 1, wherein in a case where the predetermined condition is not met, the control unit causes the cutting unit to cut a rear end position of the first page after performing the printing of the second page up to a predetermined position of the printing medium.

12. The printing apparatus according to claim 11, wherein the predetermined position is determined based on a distance between the printing unit and the cutting unit in a conveying direction in which the printing medium is conveyed by the conveying unit.

13. The printing apparatus according to claim 1, wherein in a case where the predetermined condition is met, the control unit causes the recovery unit to perform the recovery operation after causing the cutting unit to cut the printing medium and after causing the conveying unit to convey the printing medium to a retracted position.

14. The printing apparatus according to claim 1, wherein the recovery unit performs at least one of preliminary discharging operation, wiping operation, and suction recovery operation.

15. The printing apparatus according to claim 14, wherein the suction recovery operation includes operation of filling the printing unit with ink.

16. A control method of a printing apparatus comprising:

a conveying unit configured to convey a printing medium;

a printing unit configured to perform printing on the printing medium conveyed by the conveying unit;

a cutting unit capable of cutting the printing medium; and a recovery unit configured to perform recovery operation of recovering the printing unit, the method comprising:

in a case where a second page is printed subsequent to a first page, in a case where a predetermined condition concerning the recovery operation is met, after completion of the printing of the first page and prior to start of the printing of the second page, causing the recovery unit to perform the recovery operation after causing the cutting unit to cut the printing medium, and in a case where the predetermined condition is not met, causing the printing unit to start the printing of the second page without causing the cutting unit to cut the printing medium after the completion of the printing of the first page.

17. A non-transitory computer readable storage medium storing a program which causes a computer to execute a control method of a printing apparatus, the printing apparatus comprising:

a conveying unit configured to convey a printing medium;

a printing unit configured to perform printing on the printing medium conveyed by the conveying unit;

a cutting unit capable of cutting the printing medium; and a recovery unit configured to perform recovery operation of recovering the printing unit, the control method comprising:

in a case where a second page is printed subsequent to a first page, in a case where a predetermined condition concerning the recovery operation is met, after completion of the printing of the first page and prior to start of the printing of the second page, causing the recovery unit to perform the recovery operation after causing the cutting unit to cut the printing medium, and in a case where the predetermined condition is not met, causing the printing unit to start the printing of the second page without causing the cutting unit to cut the printing medium after the completion of the printing of the first page.

* * * * *